United States Patent [19]

Meyer et al.

[11] Patent Number: 4,822,237

[45] Date of Patent: Apr. 18, 1989

[54] EXTENDED REACH MATERIALS HANDLING APPARATUS

[75] Inventors: Joseph A. Meyer; John H. Frank, both of New Philadelphia, Ohio

[73] Assignee: The Gradall Company, New Philadelphia, Ohio

[21] Appl. No.: 800,577

[22] Filed: Nov. 21, 1985

[51] Int. Cl.[4] ..... B66E 9/065

[52] U.S. Cl. ..... 414/708; 414/718; 414/917

[58] Field of Search ..... 414/685, 700, 708, 718, 414/728, 917, 607

[56] References Cited

U.S. PATENT DOCUMENTS

| | | | |
|---|---|---|---|
| 3,018,011 | 1/1962 | Ackermann | 414/728 X |
| 3,230,717 | 1/1966 | Alden | 414/708 X |
| 3,288,316 | 11/1966 | West | 414/708 |
| 3,297,183 | 1/1967 | Klaviter et al. | 414/708 |
| 3,403,801 | 10/1968 | Ulinski | 414/707 |
| 3,543,957 | 12/1970 | Russell | 414/728 |
| 3,836,025 | 9/1974 | Olson et al. . | |
| 3,966,064 | 6/1976 | Felburn | 414/708 |
| 3,985,248 | 10/1976 | Liegel et al. | 414/718 |
| 3,995,746 | 12/1976 | Usagida | 414/728 X |
| 4,034,875 | 7/1977 | Pugh et al. | 414/718 |
| 4,042,135 | 8/1977 | Pugh et al. | 414/718 |
| 4,082,197 | 4/1978 | Stedman | 414/718 X |
| 4,142,308 | 6/1979 | Brandtjen | 414/718 X |
| 4,147,263 | 4/1979 | Fredrick et al. . | |
| 4,215,971 | 8/1980 | Itey-Bernard | 414/917 X |
| 4,249,854 | 2/1981 | Teti | 414/917 X |
| 4,266,909 | 5/1981 | Langenfeld et al. | 414/708 X |
| 4,381,900 | 5/1983 | Schlottman . | |
| 4,382,743 | 5/1983 | Newell . | |
| 4,408,518 | 10/1983 | Diel et al. | 414/708 X |
| 4,422,818 | 12/1983 | Molby | 414/917 X |
| 4,553,899 | 11/1985 | Magni | 414/718 X |
| 4,569,626 | 2/1986 | Sjanberg | 414/917 X |
| 4,583,907 | 4/1986 | Wimberley | 414/706 X |
| 4,632,630 | 12/1986 | Maki et al. | 414/700 |
| 4,674,944 | 6/1987 | Addleman | 414/708 |

FOREIGN PATENT DOCUMENTS

| | | | |
|---|---|---|---|
| 1059351 | 6/1959 | Fed. Rep. of Germany | 414/685 |
| 2161686 | 2/1973 | Fed. Rep. of Germany | 414/706 |
| 2527692 | 3/1976 | Fed. Rep. of Germany | 414/718 |
| 1434973 | 3/1966 | France | 414/708 |
| 2392929 | 2/1979 | France | 414/917 |
| 54966 | 4/1967 | German Democratic Rep. | 414/708 |
| 837344 | 6/1960 | United Kingdom | 414/685 |
| 2033871 | 5/1980 | United Kingdom | 414/685 |

OTHER PUBLICATIONS

Matchbox Toy Forklift, Sambron Jacklift, Apr. 14, 1986, 7 Photographs.

*Primary Examiner*—L. J. Paperner
*Assistant Examiner*—P. McCoy Smith
*Attorney, Agent, or Firm*—Kirkpatrick & Lockhart

[57] ABSTRACT

Extended-reach lift apparatus for remote accessing of low-clearance areas is provided. The apparatus includes a vehicle whose frame supports a vertically pivotable telescoping boom which is elevatable by means of hydraulic rams. An extended tilt head is provided on the free end of the boom which includes parallel upper and lower link members of equal length. A work implement support having a discrete work implement tilting cylinder is attached to the remote ends of the upper and lower links of the tilt head. A hydraulic cylinder extending between the boom and the lower link of the tilt head provides separate tiltability of the tilt head while the design of the tilt head mechanically assures the maintenance of the attitude of the work implement without requiring additional hydraulic compensation during such tilting.

14 Claims, 3 Drawing Sheets

EXTENDED REACH MATERIALS HANDLING APPARATUS

BACKGROUND OF THE INVENTION

1. Field of the Invention

This invention relates generally to a high-lift materials handling apparatus and, in particular, to a high-lift materials handling apparatus having an extended reach that may be utilized in low-clearance applications.

2. Description of the Prior Art

In a host of working environments it has become expedient to employ a high-lift materials handling apparatus having an extensible boom which is provided with a materials handling implement on the free end thereof. Such apparatus, otherwise known as a high-lift loader, facilitates the manipulation of articles from a remote location both vertically and horizontally. High-lift loaders have proven useful in a wide variety of materials handling applications in that loads can be picked up, delivered to the required site and lifted to and placed on a desired elevated surface, without the necessity of special or separate handling to transfer the load from the load handling apparatus to the elevated position. This type of apparatus has the further advantage of being able to pick up a load from a remote station which may not be stable enough to support the apparatus and deliver it to another remote station without requiring the apparatus itself be displaced completely to such location.

It will be readily appreciated that in certain applications, especially those involving military operations, it is important to provide a materials handling apparatus that may have its load handling means enter a low-height area, such as a truck or container, and lift and remove various objects therefrom. The materials handling apparatus must also have the ability to transport such objects to a point remote from but in proximity to their required location and place the objects in such location from the remote point, all while maintaining the load in a level orientation.

In conventional extended-reach materials handling apparatuses, the equipment generally includes a telescoping lift arm, commonly referred to as a boom, which is pivotally carried on a self-propelled vehicle. A separately pivotable carriage assembly to which the load handling means is attached is supported on the free end of the boom. Usually, the carriage assembly must be of sufficient height to reach from the boom end to the ground in order to pick up articles as the boom itself is not able to reach to the ground while in its retracted position.

While such apparatus may function reasonably well in certain applications, it is unsuitable for usage in a low access height environment due to the typical height of the carriage assembly. In such an application the tall carriage assembly prevents the entrance of the load handling means into a confined height area, such as a partially loaded truck or container.

One prior art apparatus has attempted to alleviate the above-described shortcoming of other prior art devices. In such apparatus, a separate tilt beam is pivotally affixed to the boom and the load handling means is pivotally attached to the end of the tilt beam thereby eliminating the tall carriage assembly of the previous systems.

A distinct shortcoming of the last-described apparatus relates to the ability of such apparatus to maintain the load level during tilting of the tilt beam relative to the boom. As will be readily appreciated, in such a prior art system when the tilt beam is tilted relative to the boom, the load will also be tilted and, if compensation for such tilting of the load is not provided, the load will be tilted to a position in which it becomes unstable and ultimately is lost. In an attempt to rectify such a situation, the prior art apparatus includes a complicated and costly system of hydraulics and electrical level sensors and controls to correct the fork attitude during tilting of the tilt beam. This system is not adequate to accurately level the load during the operation of the boom.

The subject invention is directed toward an improved extended-reach materials handling apparatus which overcomes, among others, the above-discussed problems and provides apparatus effective in performing extended reach functions in a low-height area without requiring the additional complicated, costly and inefficient electro-hydraulic fork leveling systems of previous apparatuses.

SUMMARY OF THE INVENTION

In accordance with the present invention, there is provided an extended-reach materials handling apparatus having an automatic mechanical means for maintaining fork attitude during the tilting of an extended lift member. In particular, the apparatus includes a self-propelled vehicle having a frame member which supports a vertically pivotable telescoping boom affixed at one end thereof to said frame. Hydraulic means are provided to allow the raising and lowering of the boom as well as its extension and retraction.

A tilt head support bracket is secured to the free end of the boom. In order to accomplish the low height extendibility required while maintaining a level fork attitude, an extended tilt head is pivotally attached to the tilt head support bracket. The extended tilt head includes upper and lower link members of equal length which are each pivotally attached to the tilt head support bracket. A work implement support bracket is affixed to the free ends of the upper and lower link members at points on such bracket that are the same distance apart as the points of attachment of the upper and lower link members to the tilt head support bracket. A hydraulic cylinder is connected between the tilt head support bracket and the lower link member so as to enable the tilting of the tilt head relative to the boom.

Pivotally attached to the work implement support bracket is a movable work implement such as a fork means for engaging the load to be displaced. A hydraulic cylinder is connected from the work implement to its support bracket to allow the pivoting of the work implement relative to the tilt head. As such, due to its design this invention allows the pivoting of the tilt head relative to the boom while mechanically maintaining the forks at a desired orientation and eliminates the operating restrictions encountered with apparatuses employing a tall carriage element.

Accordingly, the present invention provides an effective extended-reach materials handling apparatus for reaching into low overhead areas. As this invention allows the tilting of the tilt head relative to the boom while mechanically maintaining fork orientation, the problems of complicated and problem-ridden prior art electro-hydraulic fork leveling systems are alleviated.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 1:
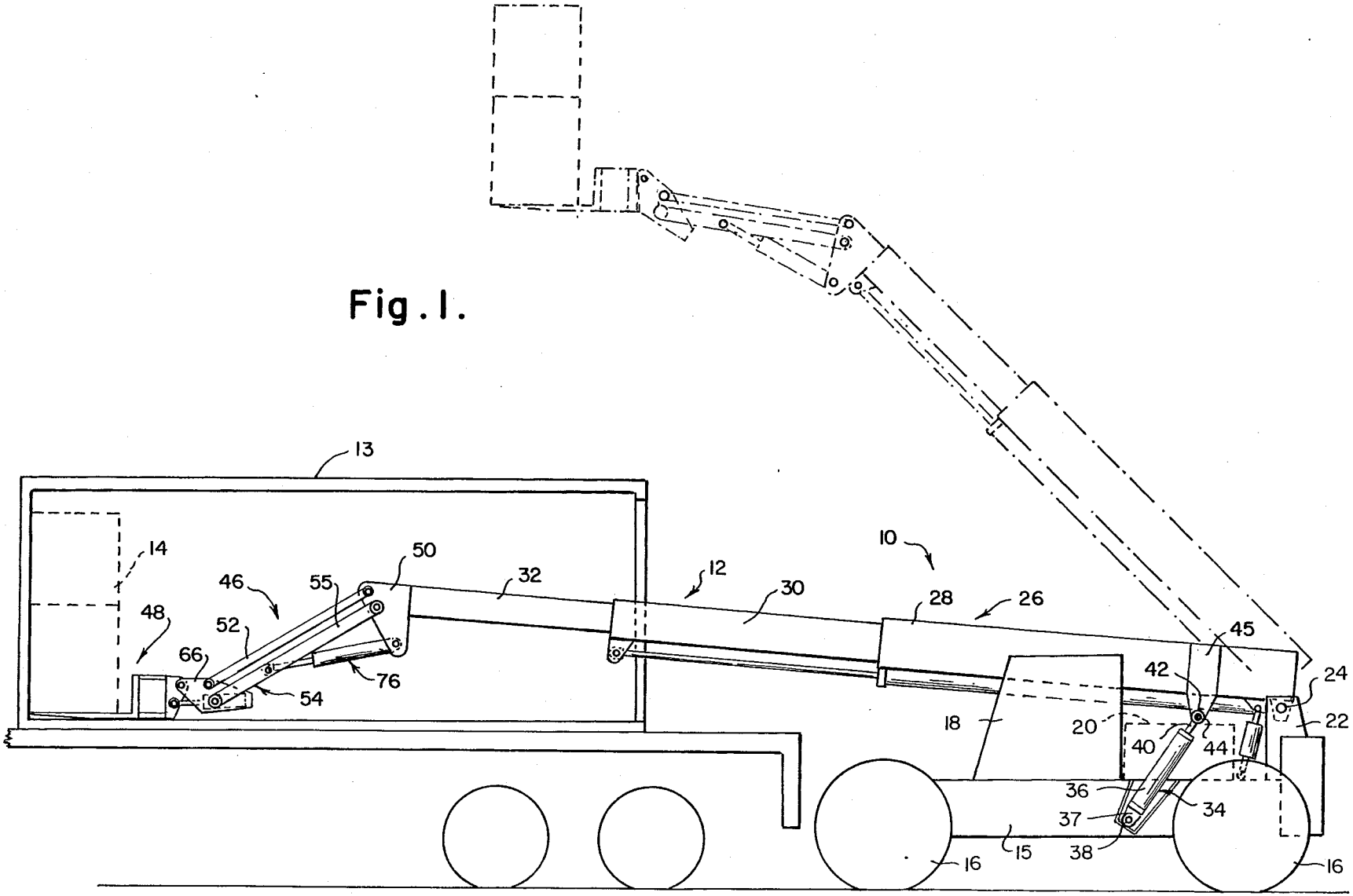
FIG. 1 is a side elevation partially schematic view of the extended-reach lift apparatus provided herein in one position with another position indicated with chain lines.
Figure 4:
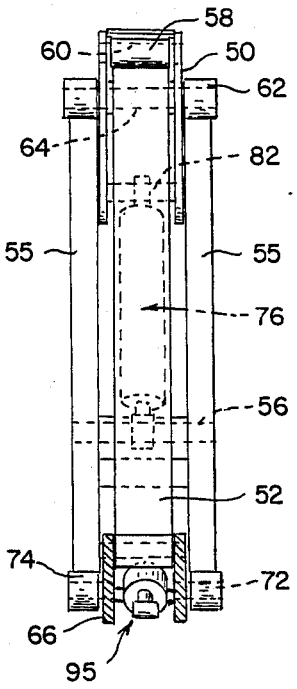
FIG. 4 is a front elevation view of the apparatus according to the present invention.
Figure 2:
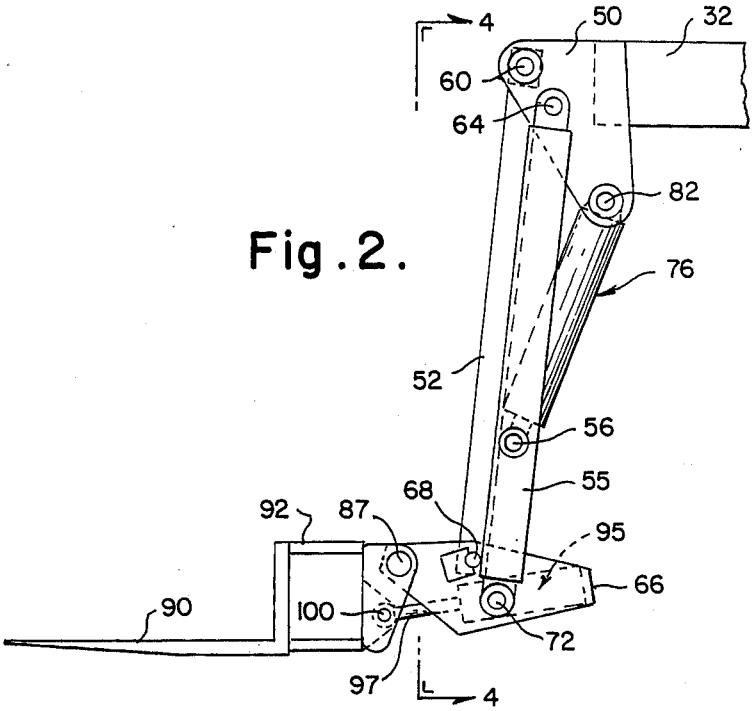
FIG. 2 is a more detailed side elevation view of the extended tiltable head of the present invention in one position.
Figure 3:
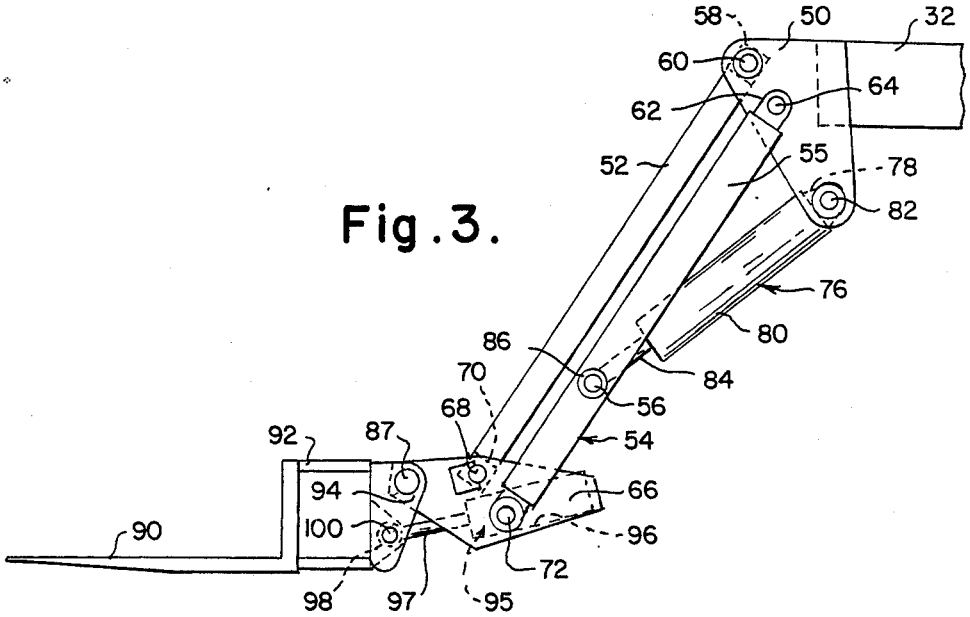
FIG. 3 is a more detailed side elevation view of another position of the extended tiltable head provided herein.
Figure 5:
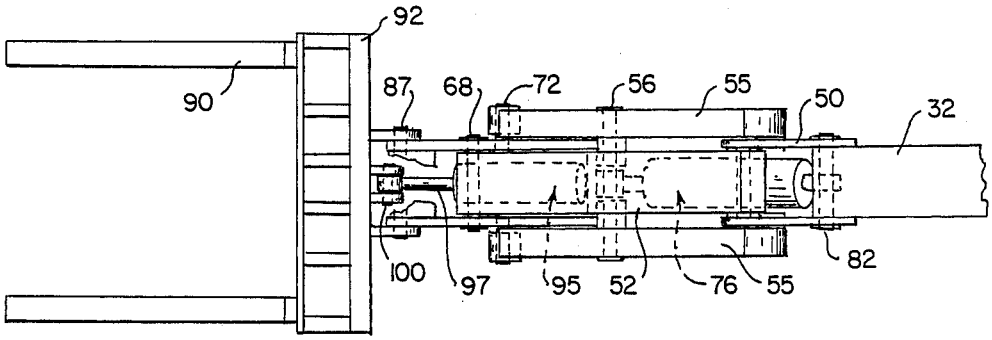
FIG. 5 is a plan view of the extended tiltable head provided herein.
Figure 6:
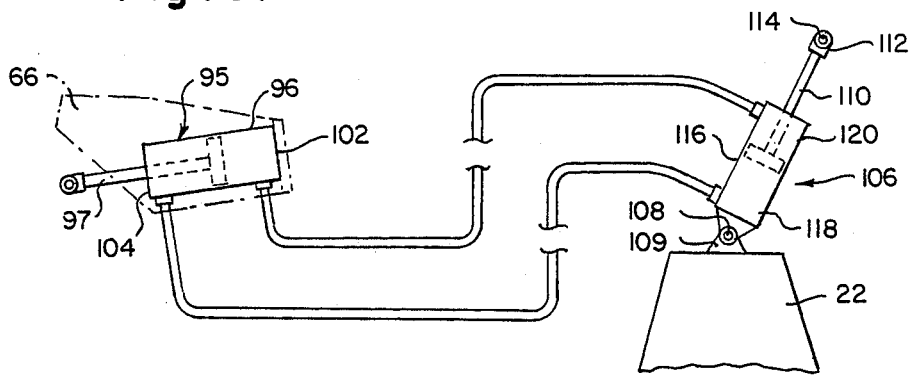
FIG. 6 is a schematic view of certain of the components of the present invention.

Referring now to the drawings wherein the showings are for purposes of illustrating the present preferred embodiments of the invention only and not for purposes of limiting same, the figures show an extended-reach lift vehicle generally designated 10, provided with an extended-reach lift apparatus indicated as 12 which is inserted into a low-height container such as a truck 13 containing articles 14.

More particularly and with reference to FIG. 1, there is shown the frame 15 of the vehicle 10 that is made mobile by means of wheels 16. The frame 15 has a cab 18 located toward the front thereof and an engine 20 located rearwardly. The engine 20 provides mechanical power for the wheels 16 as well as driving several pumps which furnish hydraulic power for the equipment to which reference will be made hereinafter.

A pair of upright standards 22 are affixed to the rear portion of frame 15. The upright standards 22 have a horizontal shaft 24 extending therebetween. The shaft 24 provides a horizontal pivot axis for a boom assembly indicated generally by the reference numeral 26. While the boom assembly 26 can be comprised of any number of telescopic boom sections, for the purposes of the present DESCRIPTION OF THE PREFERRED EMBODIMENTS reference will be made to three telescoping boom sections, 28, 30 and 32, respectively. As such, first boom section 28 is pivotally mounted on the shaft 24 while the second boom section 30 is telescopically received into first boom section 28 and third boom section 32 is telescopically received into second boom section 30. Any known means for extending second boom section 30 relative to first boom section 28 and third boom section 32 relative to second boom section 30, such as a hydraulic cylinder within a hydraulic cylinder or a hydraulic cylinder/chain arrangement may be employed to accomplish the extension of boom 26.

The entire boom assembly 26 is raised and lowered, that is, pivoted about the horizontal axis provided by the shaft 24, by means of a pair of lift cylinders 34 each having a cylinder 36 with an eye 37 at its barrel end through which extends a stub shaft 38 which is secured to frame 15. A piston rod 40 is extendably and retractably received within each cylinder 34 and is provided with an eye 42 at its free end which connects with a pin 44 mounted on bracket 45 mounted on first boom section 28.

When hydraulic fluid is delived under pressure to the closed or lower ends of cylinders 36, the piston rods 40 are extended so as to swing the boom 26 upward in conventional manner. Conversely, when hydraulic fluid is forced into the upper ends of cylinders 36, the piston rods 40 are retracted thereby lowering boom 26.

At the free or other end of the boom assembly 26 there is provided an extended tilt head assembly, generally 46, and a work implement means, generally 48. In order to support tilt head assembly 46 on the free end of third boom section 32 there is provided a tilt head support bracket 50 affixed thereto. The tilt head assembly 46 includes upper link member 52 and lower link member 54 which are always maintained in parallel relation and are of equal length. Lower link member 54 preferably includes two adjacently parallel bars 55 joined intermediate their length by means of shaft 56. Upper link 52 includes an eye 58 which cooperates with a first upper pin 60 mounted on tilt head support bracket 50 to pivotally attach upper link 52 thereto. The bars 55 of lower link member 54 are provided with eyes 62 at one end thereof which cooperate with a second lower pin 64 mounted on tilt head support bracket 50 in proximity to first upper pin 60 so as to also support lower link member 54 on the tilt head support bracket 50.

In order to support the work implement means 48 there is provided a work implement support bracket 66. Bracket 66 is provided with an upper pin 68 which cooperates with an eye 70 in the opposite end of upper link 52 from eye 58 to pivotally attach upper link 52 to bracket 66. Bracket 66 is also provided with a lower pin 72 which engages an eye 74 in each of the opposite ends of the bars 55 of lower link member 54 from eyes 62 in order to pivotally attach lower link 54 to implement support bracket 66. It is notable that the distance between the axes of pins 60 and 64 of tilt head support bracket 50 is equal to the distance between the axes of pins 68 and 72 of bracket 66.

A hydraulic cylinder 76 is pivotally affixed to tilt head support bracket 50 by means of an eye 78 formed in the end of the cylinder portion 80 of hydraulic cylinder 76 which engages a pin 82 affixed to the tilt head support bracket 50. The piston rod 84 of hydraulic cylinder 76 is provided with an eye 86 which cooperates with the intermediate shaft 56 of lower link 54. As such, when hydraulic fluid is caused to enter the end of the cylinder 80 of hydraulic cylinder 76 adjacent eye 78, the piston rod 84 is urged out of cylinder 80 thereby raising lower link 54 relative to boom 26 by pivoting it about pin 82. Such raising of lower link 54 causes an elevation of work implement support bracket 66 which is mechanically controlled by upper link 52 so that the attitude of the work implement support bracket 66 remains constant.

The work implement support bracket 66 is provided with a leading horizontal pin 87 which supports a work implement 48 such as forks 90, which forks 90 are supported by a frame 92. While reference herein will be made to the work implement 48 consisting of forks 90, it is to be understood that the work implement 48 may comprise any other suitable work implement, such as a bucket or a drop block. Frame 92 includes an eye 94 which cooperates with pin 87 to support forks 90 on work implement support bracket 66. In order to independently tilt the forks 90 relative to tilt head assembly 46 there is provided a hydraulic cylinder 95, the cylinder portion 96 of which is pivotally attached to lower work implement support bracket pin 72. Hydraulic cylinder 95 includes a piston rod 97 having an eye 98 which engages a pin 100 on frame 92. The cylinder portion 96 of hydraulic cylinder 95 is provided with a first chamber 102 adjacent the closed end thereof and a second chamber 104 disposed on opposite side of the piston of piston rod 97 from said first chamber 102. As such, when hydraulic fluid is forced into first chamber 102 the piston rod 97 is urged out of cylinder 96 thereby pivoting forks 90 upward about pin 87. Conversely when hydraulic fluid is forced into second chamber 104, the piston rod 97 is retracted into cylinder 96 and forks 90 are tilted downward about pin 87.

In order to assure that forks 90 will maintain a constant attitude during the raising of boom 26 by hydraulic rams 34, a master cylinder 106 is provided. Master cylinder 106 is pivotally affixed to frame 15 by means of pin 108 passing through an eye 109 on the upright standards 22. Master cylinder 106 includes a piston rod 110 having an eye 112 which engagingly cooperates with a pin 114 mounted on first boom section 28. Also, master cylinder 106 includes a cylinder 116 having a first chamber 118 adjacent the closed end of cylinder 116 and a second chamber 120 on the opposite side of the piston of piston rod 110.

In operation, the fork tilt hydraulic cylinder 95 is in fluid communication with and acts as a slave cylinder to master cylinder 106 to maintain fork 90 attitude. That is, the first chamber 118 of master cylinder 106 is in fluid communication with the second chamber 104 of fork tilt hydraulic cylinder 95 and the second chamber 120 of master cylinder 106 is in fluid communication with the first chamber 102 of fork tilt hydraulic cylinder 95. As such, when lift ram 34 elevates boom 26, the piston rod 110 of master cylinder 106 is displaced upward thereby urging hydraulic fluid out of the second chamber 120 of master cylinder 106 and into the first chamber of fork tilt hydraulic cylinder 95 which causes the forks 90 to be lowered an amount in correspondence with the elevating of the boom 26. Conversely, when boom 26 is lowered the piston rod 110 of master cylinder 106 is displaced downward thereby forcing hydraulic fluid out of the first chamber 118 of master cylinder 106 and into the second chamber 104 of fork tilt hydraulic cylinder 95 which causes the forks 90 to be raised an amount commensurate with the extent of the lowering of boom 26. Of course, by-pass means are connected to first and second chambers, 102 and 104 of fork tilt hydraulic cylinder 95 to independently control fork 90 tilting when such is desired.

Accordingly, the relationship between master cylinder 106 and fork tilt cylinder 95 is effective to maintain a desired fork 90 attitude during boom 26 tilting. However, it must be recognized that, unlike the prior art hydraulic means for achieving fork leveling during tilt head tilting, the present invention provides a more simple and accurate means for maintaining fork 90 attitude during the tilting of tilt head 46 relative to boom 26. From above, to tilt the tilt head 46 hydraulic fluid is urged into the closed end of the chamber 80 of tilt head hydraulic cylinder 76 thereby extending piston rod 84 and pivoting lower link 54 about pin 82. Due to the geometric relationship between upper link 52 and lower link 54 and the distances between pins 68 and 72, and 82 and 87, respectively, when lower link 54 is lowered or raised, the attitude of work implement support bracket 66 and, hence, forks 90 is automatically maintained. But for the operation of the tilt head 46 as provided herein, a second master cylinder/slave cylinder arrangement or another complicated means would be required to maintain fork 90 attitude during the tilting of tilt head 46 relative to boom 26.

It will be understood that various changes in the details, materials and arrangements of parts which have been herein described and illustrated in order to explain the nature of the invention, may be made by those skilled in the art within the principle and scope of the invention as expressed in the appended claims.

what is claimed is:

1. An extended-reach lifting apparatus adapted for mounting on a supporting frame comprising:

a. a boom means comprising:
   (i) a base boom section vertically pivotally supported at one end thereof by said supporting frame;
   (ii) at least one telescoping boom section supported by and extendible from and retractable into said base boom section, the end of said at least one telescoping boom section remote from said base boom section when said telescoping boom section is extended comprising the free end of said boom means; and
   (iii) means for extending and retracting said at least one telescoping boom section relative to said base boom section;

b. means for vertically pivoting said boom means relative to said supporting frame;

c. a work implement means;

d. an extended tilt head assembly vertically pivotally attached to said free end, said tilt head assembly comprising:
   (i) a tilt head support bracket affixed to said free end;
   (ii) an upper link member vertically pivotally attached at one end thereof to said tilt head support bracket at a first point thereon;
   (iii) a lower link member vertically pivotally attached at one end thereof to said tilt head support bracket at a second point thereon; and
   (iv) a second bracket vertically pivotally attached to the other end of said upper link member and to the other end of said lower link member, said second bracket vertically pivotally supporting said work implement means;

e. means for vertically pivoting said upper link member, said lower link member and said second bracket relative to said boom means, said tilt head assembly being effective upon the vertical pivoting of said upper and said lower link members and said second bracket about said boom means to maintain said work implement means in a predetermined vertical orientation; and f. control means connected to said work implement means for maintaining said work implement means in, alternatively, either a predetermined horizontally level or non-level orientation upon the vertical pivoting of said boom means relative to said supporting frame.

2. Apparatus of claim 1 in which said control means comprises:

a. a first hydraulic cylinder connected between said work implement means and said second bracket;

b. a second hydraulic cylinder connected between said base boom section and said supporting frame, said second hydraulic cylinder being in fluid communication with said first hydraulic cylinder such that upon the vertical pivoting of said boom means relative to said supporting frame, said first hydraulic cylinder acts as a slave cylinder to said second hydraulic cylinder to maintain said work implement means in a predetermined orientation.

3. Apparatus of claim 2 in which:

a. said lower link member is of equal length to said upper link member and, b. said second bracket is pivotally attached to the other end of said upper link member at a first point on said second bracket and to the other end of said lower link member at a second point on said second bracket, such that the distance between said first and said second points on said tilt head support bracket is equal to the distance between said first and said second points on said second bracket.

4. Apparatus of claim 3 in which said lower link member comprises:

a. a pair of parallel bars each of said bars being pivotally attached at one end thereof to said tilt head support bracket at the points of intersection of a horizontal normal line through said second point on said tilt head support bracket and being pivotally attached at the other end thereof to said second bracket at the points of intersection of a horizontal normal line through said second point on said second bracket; and, b. a shaft normal to both of said parallel bars and affixed intermediate the lengths thereof.

5. Apparatus of claim 4 in which said means for tilting said tilt head comprises a hydraulic cylinder pivotally attached at one end thereof to said tilt head support bracket and pivotally attached at the other end thereof to said shaft between said bars of said lower link.

6. Apparatus of claim 5 further comprising means for operating said first hydraulic cylinder independently of said second hydraulic cylinder.

7. Apparatus of claim 6 in which said work implement means comprises lifting forks.

8. An extended-reach lift vehicle, comprising:

a. a vehicle chassis having a frame, an engine mounted to said frame and a plurality of wheels supporting said frame, at least two of said wheels being driven by said engine;

b. a boom means comprising:

(i) a base boom section vertically pivotally supported at one end thereof by said frame;

(ii) at least one telescoping boom section supported by and extendible from and retractable into said base boom section, the end of said at least one telescoping boom section remote from said base boom section when said telescoping boom section is extended comprising the free end of said boom means; and (iii) means for extending and retracting said at least one telescoping boom section relative to said base boom section;

c. means for vertically pivoting said boom means relative to said frame;

d. a work implement means;

e. an extended tilt head assembly vertically pivotally attached to said free end, said tilt head assembly comprising:

(i) a tilt head supporting bracket affixed to said free end;

(ii) an upper link member vertically pivotally attached at one end thereof to said tilt head support bracket at a first point thereon;

(iii) a lower link member vertically pivotally attached at one end thereof to said tilt head support bracket at a second point thereon; and (iv) a second bracket vertically pivotally attached to the other end of said upper link member and to the other end of said lower link member, said second bracket vertically pivotally supporting said work implement means;

f. means for vertically pivoting said upper link member, said lower link member and said second bracket relative to said boom means, said tilt head assembly being effective upon the vertical pivoting of said upper and said lower link members and said second bracket about said boom means to maintain said work implement means in a predetermined vertical orientation; and g. control means connected to said work implement means for maintaining said work implement means in, alternatively, either a predetermined horizontally level or non-level orientation upon the vertical pivoting of said boom means relative to said frame.

9. The vehicle of claim 8 in which said control means comprises:

a. a first hydraulic cylinder connected between said work implement means and said second bracket;

b. a second hydraulic cylinder connected between said base boom section and said frame, said second hydraulic cylinder being in fluide communication with said first hydraulic cylinder such that upon the vertical pivoting of said boom means relative to said frame, said first hydraulic cylinder acts as a slave cylinder to said second hydraulic cylinder to maintain said work implement means in a predetermined orientation.

10. The vehicle of claim 9 in which:

a. said lower link member is of equal length to said upper link member; and, b. said bracket is pivotally attached to the other end of said upper link member at a first point on said second bracket and to the other end of said lower link member at a second point on said second bracket, such that the distance between said first and said second points on said tilt head support bracket is equal to the distance between said first and said second points on said second bracket.

11. The vehicle of claim 10 in which said lower link member comprises:

a. a pair of parallel bars each of said bars being pivotally attached at one end thereof to said tilt head support bracket at the points of intersection of a horizontal normal line through said second point on said tilt head support bracket and being pivotally attached at the other end thereof to said second bracket at the points of intersection of a horizontal normal line through said second point on said second bracket; and, b. a shaft normal to both of said parallel bars and affixed intermediate the lengths thereof.

12. The vehicle of claim 11 in which said means for tilting said tilt head comprises a hydraulic cylinder pivotally attached at one end thereof to said tilt head support bracket and pivotally attached at the other end thereof to said shaft between said bars of said lower link.

13. The vehicle of claim 12 further comprising means for operating said first hydraulic cylinder independently of said second hydraulic cylinder.

14. The vehicle of claim 13 in which said work implement means comprises lifting forks.

* * * * *

UNITED STATES PATENT AND TRADEMARK OFFICE

CERTIFICATE OF CORRECTION

PATENT NO. : 4,822,237

DATED : April 18, 1989

INVENTOR(S) : Joseph A. Meyer et al.

It is certified that error appears in the above-identified patent and that said Letters Patent is hereby corrected as shown below:

Title page:

In References Cited: U.S. PATENT DOCUMENTS, after "4,142,308", delete "6/1979" and substitute therefor --3/1979--.

In References Cited: OTHER PUBLICATIONS, insert --Koehring Apparatus Disclosure (Corresponding to Maki et al. 4,632,630)--.

Col. 4, line 5, delete "delived" and substitute therefor --delivered--.

Col. 8, line 29, delete "fluide" and substitute therefor --fluid--.

Signed and Sealed this

Ninth Day of January, 1990

*Attest:*

JEFFREY M. SAMUELS

*Attesting Officer* *Acting Commissioner of Patents and Trademarks*